US007152548B2

(12) United States Patent
Barstow et al.

(10) Patent No.: US 7,152,548 B2
(45) Date of Patent: Dec. 26, 2006

(54) BOAT WITH DIVE ELEVATOR

(76) Inventors: Greg Barstow, 7040 NW. Waukomis Dr., Kansas City, MO (US) 64155; Mark Sanchez, 511 Oakbrook Dr., Lansing, KS (US) 66043

( * ) Notice: Subject to any disclaimer, the term of this patent is extended or adjusted under 35 U.S.C. 154(b) by 0 days.

(21) Appl. No.: 11/115,454

(22) Filed: Apr. 27, 2005

(65) Prior Publication Data

US 2006/0243187 A1 Nov. 2, 2006

(51) Int. Cl.
*B63C 11/46* (2006.01)
*B63B 35/40* (2006.01)

(52) U.S. Cl. ..... 114/315; 114/258

(58) Field of Classification Search ..... 114/362, 114/258, 315, 313
See application file for complete search history.

(56) References Cited

U.S. PATENT DOCUMENTS 3,883,910 A * 5/1975 Naylor, III ..... 114/355
4,245,578 A * 1/1981 Bianco et al. ..... 114/312
4,312,287 A * 1/1982 Kuo ..... 114/259
4,702,189 A * 10/1987 Schlichthorst ..... 114/61.1
5,025,747 A 6/1991 Grayson
5,537,949 A 7/1996 Blevins
5,887,540 A 3/1999 Krish, Jr.
5,915,328 A 6/1999 Rowan
6,058,875 A 5/2000 Krish, Jr.
6,119,809 A 9/2000 McClendon, Jr.
6,182,598 B1 2/2001 Bozzo
6,698,371 B1 3/2004 Stoltzfus

* cited by examiner

*Primary Examiner*—Jesús D. Sotelo
(74) *Attorney, Agent, or Firm*—Lathrop & Gage, LLC

(57) ABSTRACT

A boat comprises an elevator and a boat hull having a deck and defining a dive opening. The dive opening extends vertically from the deck to the water and defines an enclosed passageway having upper and lower openings. Depending on the dive opening's location in the boat hull, the passageway may or may not be enclosed on all sides. Means are included for selectively moving the elevator between a raised configuration above the dive opening and a lowered configuration by passing through the passageway. A floor of the elevator is adjacent the boat hull deck when the elevator is at the raised configuration, and the elevator floor is below a water surface when the elevator is at the lowered configuration so a user may easily travel between the water and the elevator. Means for actuating the means for moving the elevator are preferably accessible from inside and outside the elevator.

15 Claims, 4 Drawing Sheets

BOAT WITH DIVE ELEVATOR

BACKGROUND OF THE INVENTION

This invention relates generally to a boat used for diving. In particular, the present invention relates to a boat having a dive elevator for allowing a diver to easily exit and board the boat.

Water sports such as dividing and snorkeling are very popular today, and many people enjoy diving and snorkeling from a boat in order to distance themselves from land or explore various underwater locations. Part of the attraction to these sports is that many people with physical ailments (including back problems, leg injuries, arm injuries, and countless other conditions) can participate, and indeed swimming and other water activities are often suggested by medical practitioners for physical rehabilitation. Nevertheless, there has been a large obstacle to diving, swimming, and snorkeling from a boat for many people—the acts of entering the water from the boat and returning to the boat from the water.

Various proposals for platforms, ladders, and stairways that ease the exiting and boarding processes are found in the art, such as in U.S. Pat. Nos. 5,025,747; 5,537,949; 6,058,875; 6,119,809; and 6,182,598. While assembly effective for their intended purposes, these devices do not provide enough assistance to those able to dive or snorkel but unable to physically master stairs or a ladder.

In recognizing the difficulties that many people encounter when entering the water from a boat and entering a boat from the water, U.S. Pat. No. 5,887,540 discloses a mechanism chair lift system securable to a hinged stairway system for attachment to the side of a water vehicle. A user sits in a chair that is mechanically maneuvered at an angle between the boat and the water. Though this would assumably aid many people, it requires the user to sit down before being lowered and raised, and it enlarges the footprint of the boat. This seating requirement would be very difficult for those with certain ailments, such as back or hip problems, and should be avoided if possible. It would also be advantageous to keep the boat's footprint to a minimum in order to navigate shallow waters and reach certain areas. Clearly , a boat with means for transporting users to and from the water without requiring a certain configuration of the user would be advantageous since it could be used by a broader range of those with physical ailments.

SUMMARY OF THE INVENTION

A boat according to the present invention comprises an elevator and a boat hull having a deck and defining a dive opening. The dive opening extends vertically from the boat hull deck to the water and defines an enclosed passageway having an upper opening and a lower opening. Depending on the location of the dive opening in the boat hull, the passageway may be enclosed on all sides or on less than all sides. Means are included for selectively moving the elevator between a raised configuration above the dive opening to a lowered configuration. A floor member of the elevator is adjacent the boat hull deck when the elevator is at the raised configuration so a user may easily pass between the boat hull deck and the elevator, and the elevator floor member is below a water surface when the elevator is at the lowered configuration so a user may easily pass between the water and the elevator. The elevator passes through the passageway to move between the raised and lowered configurations.

Means for actuating the means for selectively moving the elevator are preferably accessible from inside and outside the elevator.

In use, the boat hull is placed in the water, and a user wishing to enter the water from the boat hull deck enters the elevator. A switch may be activated to actuate the means for selectively moving the elevator. The means for selectively moving the elevator then moves the elevator to the lowered configuration, allowing the user to easily enter the water. To board the boat from the water, the user enters the elevator at the lowered configuration from the water, and a switch is activated to actuate the means for selectively moving the elevator. The means for selectively moving the elevator then moves the elevator to the raised configuration, allowing the user to easily move to the boat hull deck from the elevator.

Therefore, a general object of this invention is to provide a boat that has a dive elevator for easily transporting users between the boat and the water.

Another object of this invention is to provide a boat, as aforesaid, with a dive elector that can be operated from both outside and inside the dive elevator.

Still another object of this invention is to provide a boat, as aforesaid, with a dive elevator that is easy and safe to use.

Yet another object of this invention is to provide a boat, as aforesaid, that does not have an exaggerated footprint.

A further object of this invention is to provide a boat, as aforesaid, that is seaworthy.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
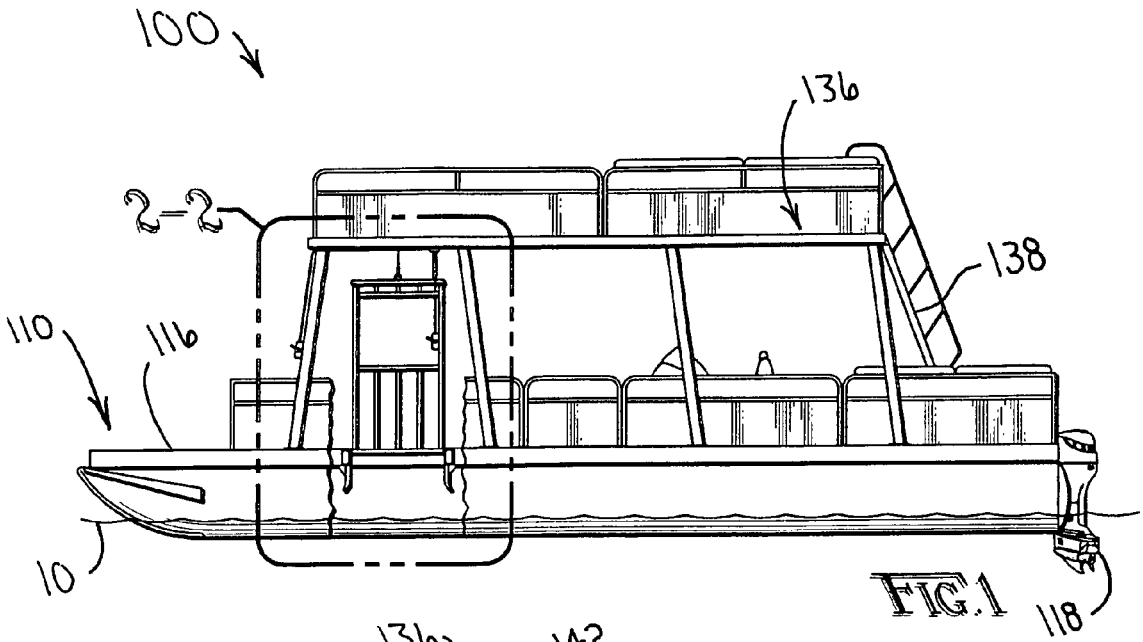
FIG. 1 is a side view of a boat with a dive elevator.

A boat according to the present invention will now be described in detail with reference to FIGS. 1 through 7 of the accompanying drawings. More particularly, a boat 100 for use in water 10 comprises a boat hull 110 defining a dive opening 112 and an elevator 120 (FIG. 1).

The boat hull 110 has a deck 116, and the dive opening (also called the dive shaft) 112 extends vertically from the boat hull deck 116 to the water 10. The dive shaft 112 defines an enclosed passageway 114 having an upper opening 114*a* and a lower opening 114*b*. It is to be understood that the passageway 114 may be enclosed on all sides (FIG. 5) or on less than all sides (FIG. 6), depending on its location in the boat hull 110. While the boat hull 110 is preferably a pontoon boat hull as shown in the accompanying drawings, this does not have to be the case; other types of boat hulls may be incorporated into the current invention. Means for propelling the boat hull through the water 10, such as a propeller 118 or a waterjet, may be included.

The elevator 120 has opposed floor and roof members 122, 124 connected by a side member 126 and may incorporate additional elements such as railing 128 or a seat (not shown). Means are included for vertically moving the elevator 120 between a raised configuration 120*a* in which the elevator 120 rests above the dive shaft 112 and a lowered configuration 120*b* in which the elevator floor 122 is lower than the boat hull deck 116. The elevator floor 122 is preferably adjacent the deck 116 when the elevator 120 is at the raised configuration 120*a,* and the elevator floor 122 is preferably located below a surface of the water 10 when the elevator 120 is at the lowered configuration 120*b*. The elevator 120 passes through the passageway 114 to move between the raised and lowered configurations 120*a,* 120*b*.

The means for selectively moving the elevator 120 vertically preferably comprise a winch 140 having a free end 142 attached to the elevator 120. The free end 142 preferably attaches to the roof member 124. Alternatively, the means for selectively moving the elevator 120 may include a hydraulic lifting system (not shown), a rack and pinion system (not shown) in which a rack is located along the elevator side member 126 and a corresponding pinion is attached to the boat hull 110 inside the dive shaft 112, or another lifting system.

A support frame 130 is attached to the boat hull 110. The support frame 130 comprises a first member 132 extending upwardly from the boat hull 110 and a second member 134 attached adjacent a top end 132*a* of the first member 132 and extending generally horizontally therefrom. There are preferably a plurality of first members (also called upward members) 132, and a plurality of second members (also called horizontal members) preferably span the top ends 132*a* of the upward members 132 to create an upper deck 136 (FIG. 1). A ladder 138 is located adjacent the support frame 130 to provide access from the deck 116 to the upper deck 136

In a preferred embodiment, the winch 140 is operatively attached to the support frame second member 134 above the dive opening 112. The winch 140 may be located adjacent the support frame second member 134 (FIG. 3), or a pulley 148 may attach the winch 140 to the support frame second member 134 (FIG. 4).

Figure 7:
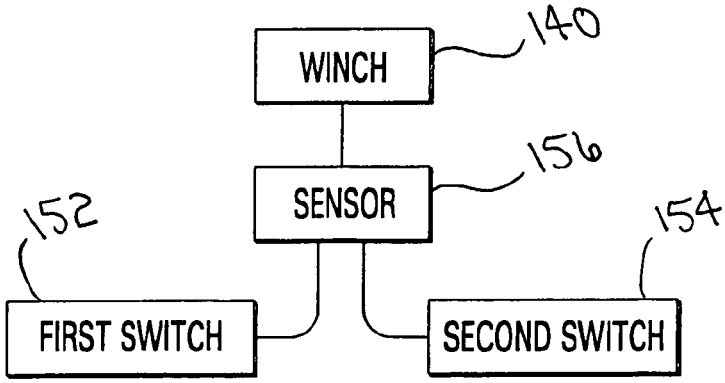
FIG. 7 is a block diagram of the winch, a sensor, and switches as in FIG. 2.

The boat 100 includes means for actuating the members for selectively moving the elevator 120. This actuation means preferably comprises a first switch 152 in communication with the winch 140 and a second switch 154 in communication with the winch 140 (FIG. 7). The first switch 152 is preferably mounted separate from the elevator 120 for use from outside the elevator 120, and the second switch 154 is preferably attached to the elevator 120 for use from inside the elevator 120. The second switch 154 should be a waterproof switch that may be safely used while submerged in the water 10. It is understood that other means for selectively moving the elevator 120 may be incorporated, as described above.

A sensor 156 is preferably connected to the means for selectively moving the elevator 120 (such as the winch 140) for determining when the elevator 120 is at the raised configuration 120*a* and halting the means for selectively moving the elevator 120 when the elevator 120 is at the raised configuration 120*a* (FIG. 7).

In use, the boat hull 110 is placed in the water 10 and maneuvered as desired by the propeller 118. When a user wishes to enter the water 10, he passes from the deck 116 to the elevator 120. He may stand on the elevator floor 122 and activate the second switch 154, or someone else may activate the first switch 152 from outside the elevator 120. Activating the first or second switch 152, 154, respectively, actuates the means for selectively moving the elevator 120 (preferably the winch 140). The winch 140 in turn moves the elevator 120 vertically through the dive shaft passageway 114 to the lowered configuration 120*b* (FIG. 3), placing the user in the water 10. Since minimal effort is required of the user, almost anyone can enter the water 10 in this fashion, even if they have a range of physical ailments.

Figure 2:
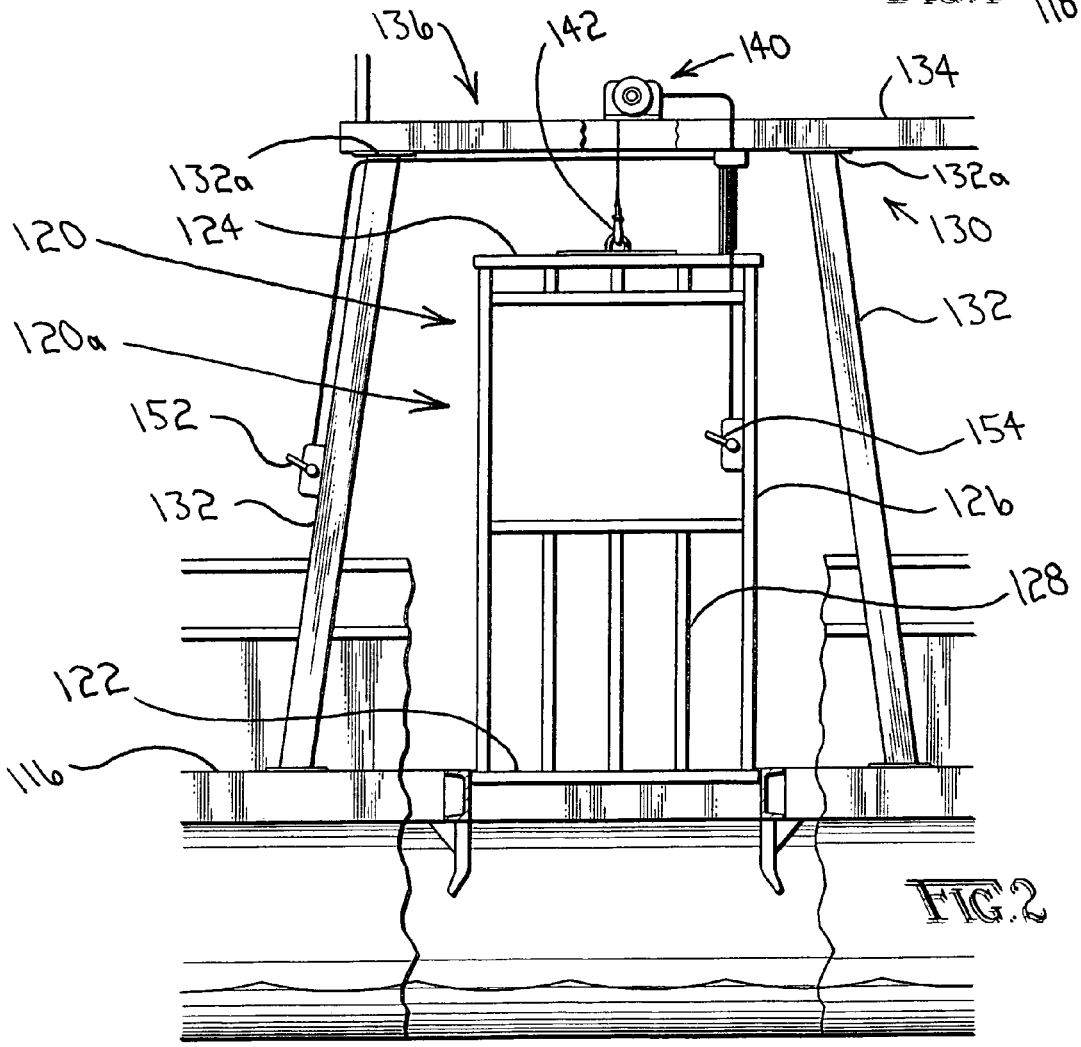
FIG. 2 is a sectional view of the dive elevator at a raised configuration, a support frame, and a winch as in FIG. 1.
Figure 3:
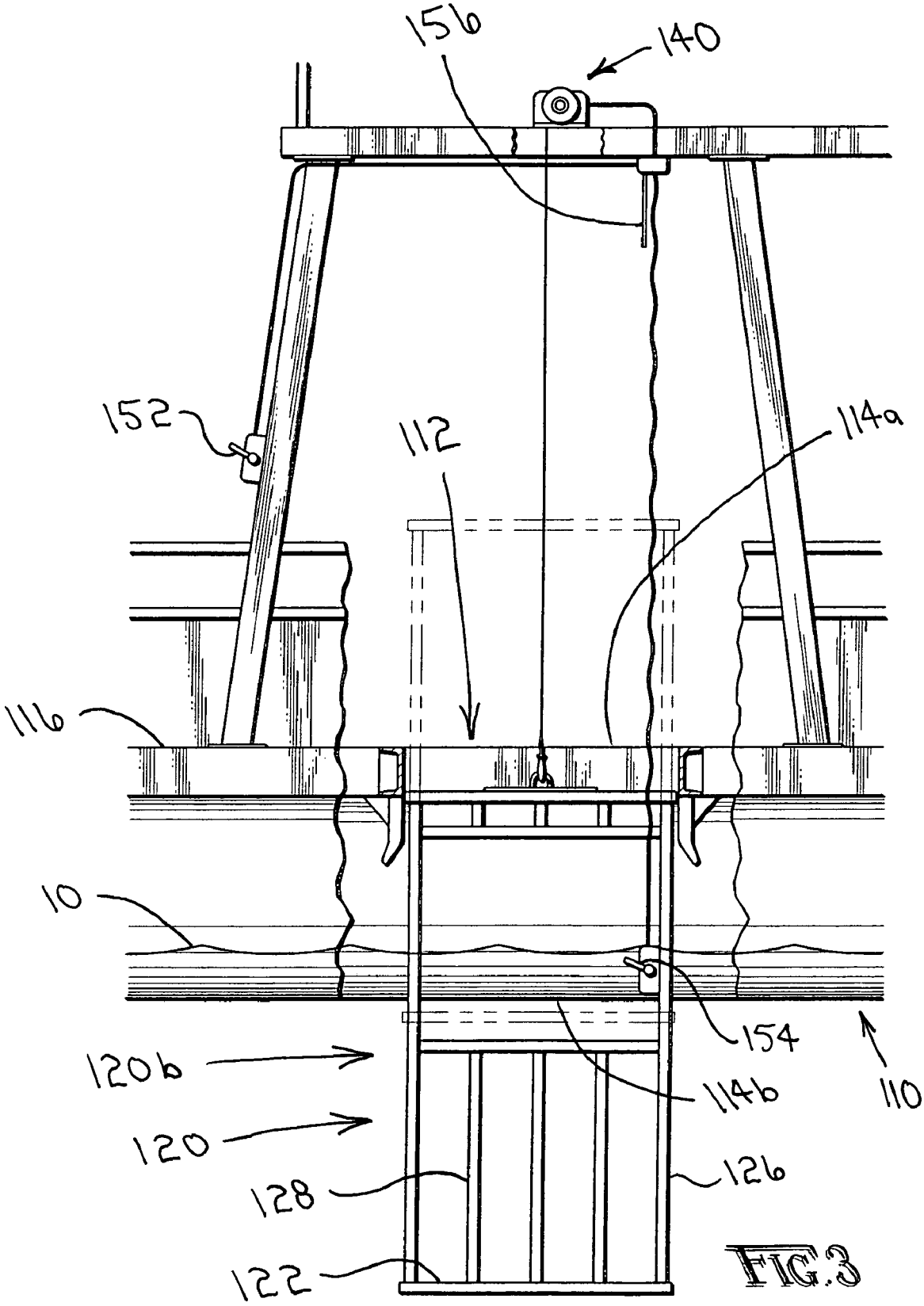
FIG. 3 is a sectional view as in FIG. 2 with the dive elevator at a lowered configuration and showing an intermediate position of the dive elevator in hidden lines.
Figure 4:
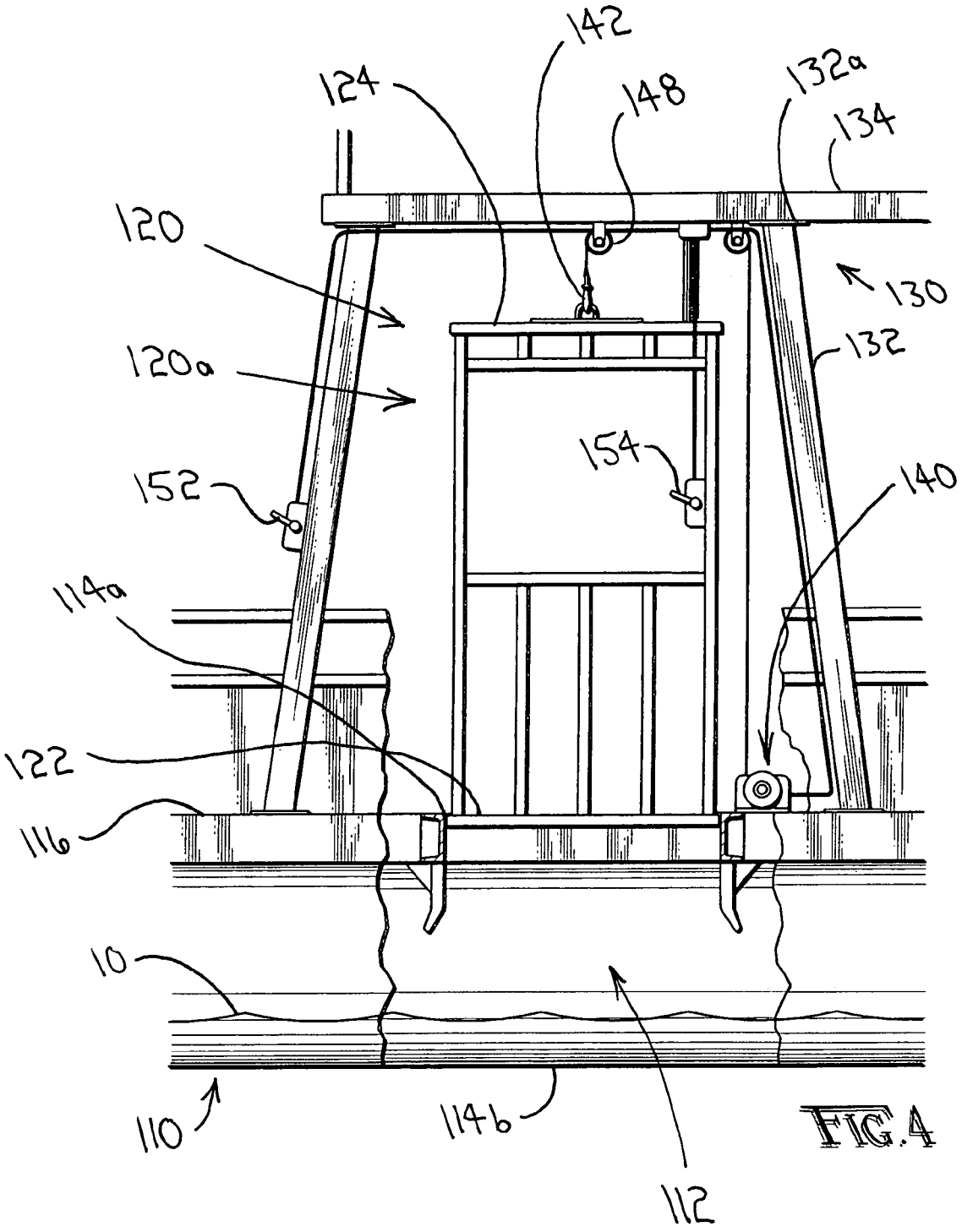
FIG. 4 is a sectional view as in FIG. 2 with a pulley attaching the winch to the support frame.
Figure 5:
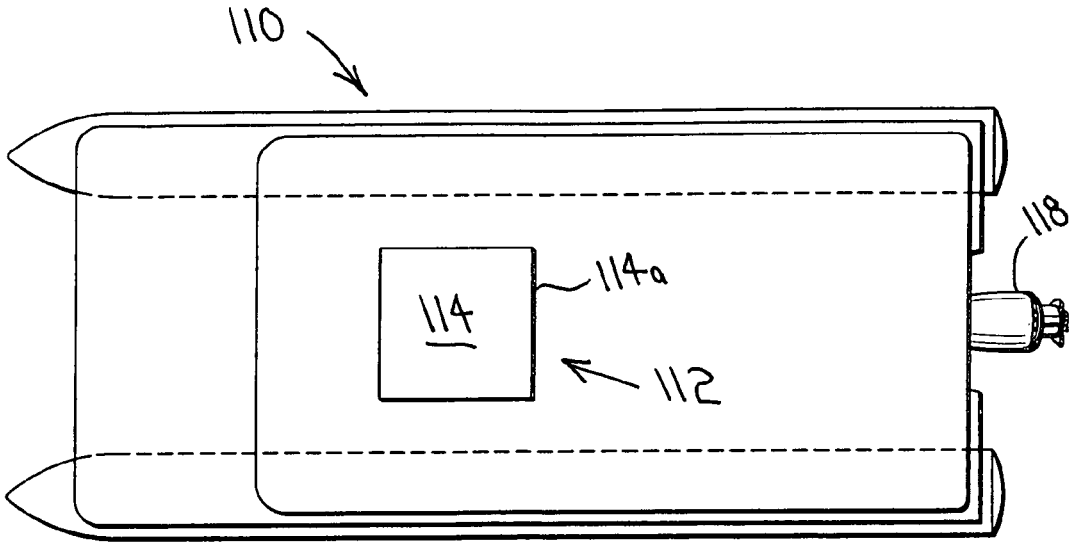
FIG. 5 is a top view of a boat hull as in FIG. 1 with a dive shaft located in the center of the boat hull.
Figure 6:
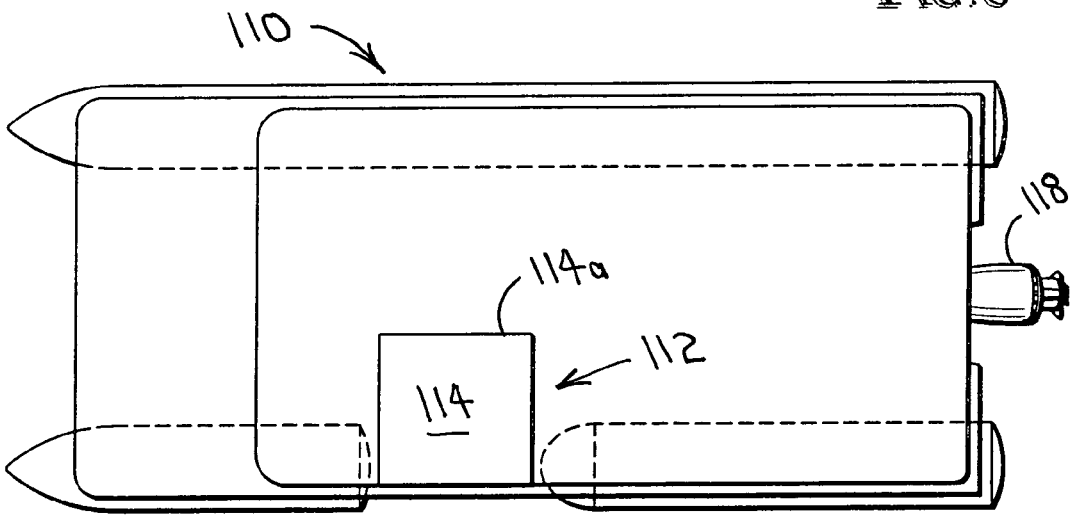
FIG. 6 is a top view of the boat hull as in FIG. 5 with the dive shaft located along a side of the boat hull.

When the user wishes to board the boat 100 from the water 10, he enters the elevator 120 at the lowered configuration 120*b* (FIG. 3). He may then activate the second switch 154, or someone else may activate the first switch 152 from outside the elevator 120. Activating the first or second switch 152, 154, respectively, actuates the means for selectively moving the elevator 120 (preferably the winch 140). The winch 140 in turn moves the elevator 120 vertically through the dive shaft passageway 114 to the raised configuration 120*a* (FIG. 2). The sensor 156 may detect the presence of the elevator 120 at the raised configuration 120*a* and halt the winch 140. When the elevator 120 is at the raised configuration 120*a,* the elevator floor 122 is adjacent the deck 116 and the user may easily pass from the elevator 120 to the deck 116.

If the winch 140 is located adjacent a horizontal memer 134 of the support frame 130 (FIGS. 2 and 3), the ladder 138 may be used to access the winch 140 for maintenance or repairs.

It is understood that while certain forms of this invention have been illustrated and described, it is not limited thereto except insofar as such limitations are included in the following claims and allowable functional equivalents thereof.

What is claimed is:

1. A boat for use in water, comprising:

a boat hull defining a dive opening;

a support frame attached to said boat hull, said support frame comprising a first member extending upwardly from said boat hull and a second member attached adjacent a top end of said first member and extending generally horizontally therefrom;

an elevator having a floor member;

a winch operatively attached to said support frame second member above said dive opening, said winch having a free end attached to said elevator for selectively moving said elevator between a raised configuration and a lowered configuration; and a switch in communication with said winch for selectively actuating said winch.

2. The boat as in claim 1, wherein:

said boat hull has a deck; and said elevator floor is located below said boat hull deck when said elevator is at said lowered configuration.

3. The boat as in claim 1, wherein:

said boat hull has a deck;

said dive opening extends vertically from said boat hull deck to the water;

said elevator floor is located below a surface of the water when said elevator is at said lowered configuration.

4. The boat as in claim 3, wherein:

said switch is separate from said elevator; and said boat further comprises a second switch in communication with said winch for selectively actuating said winch, said second switch being attached to said elevator.

5. The boat as in claim 4, wherein said second switch is waterproof.

6. The boat as in claim 1, further comprising a sensor connected to said winch to determine when said elevator is at said raised configuration said half said winch when said elevator is at said raised configuration.

7. The boat as in claim 1, wherein a pulley attaches said winch to said support frame second member.

8. The boat as in claim 1, wherein:

said winch is located adjacent said support frame second member; and said boat further comprises a ladder adjacent said support frame for winch access.

9. The boat as in claim 1, wherein:

said boat hull is a pontoon boat hull; and said boat further comprises means for propelling said boat hull through the water.

10. A boat for use in water, comprising:

a boat hull defining a dive shaft;

a support frame attached to said boat hull, said support frame comprising a plurality of upward members having respective top ends and a plurality of horizontal members spanning said top ends;

an elevator having opposed floor and roof members connected by a side member;

a winch attached to a respective said support frame horizontal member above said dive shaft, said winch having a free end attached to said elevator roof member for selectively moving said elevator between a raised configuration and a lowered configuration; and means for actuating said winch to move said elevator between said raised and lowered configurations.

11. The boat as in claim 10, wherein:

said boat hull has a deck; and said dive shaft extends vertically from said boat hull deck to the water, said dive shaft defining an enclosed passageway having an upper opening and a lower opening.

12. The boat as in claim 10, wherein said means for actuating said winch includes a first switch in communication with said winch.

13. The boat as in claim 12, wherein:

said first switch is separate from said elevator; and said means for actuating said winch further comprises a second switch in communication with said winch, said second switch being attached to said elevator.

14. The boat as in claim 10, further comprising a ladder connecting said boat hull to said plurality of horizontal members.

15. A boat for use in water, comprising:

a boat hull having a deck and defining a dive shaft, said dive shaft extending vertically from said boat hull deck to the water, said dive shaft defining an enclosed passageway having an upper opening and a lower opening;

an elevator having a floor member, said elevator floor being adjacent said upper opening of said passageway when said elevator is at said raised configuration, said elevator floor being below a surface of the water when said elevator is at said lowered configuration;

means for vertically moving said elevator between a raised configuration in which said elevator rests above said dive shaft and a lowered configuration in which said elevator floor is lower than said boat hull deck, said means for vertically moving said elevator comprising a winch operatively attached to said elevator;

means for actuating said means for moving said elevator; and a sensor operatively connected to said winch to determine when said elevator is at said raised configuration and half said winch when said elevator is at said raised configuration; and wherein said elevator passes through said passageway to move between said raised and lowered configurations.

* * * * *